US006327985B1

(12) United States Patent
Frenkler et al.

(10) Patent No.: US 6,327,985 B1
(45) Date of Patent: Dec. 11, 2001

(54) DESK WITH EXPANSIBLE LEGS

(75) Inventors: Fritz Frenkler, Hannover; Justus Kolberg, Hamburg, both of (DE)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 09/485,584

(22) PCT Filed: Jun. 14, 1999

(86) PCT No.: PCT/JP99/03169

§ 371 Date: Feb. 14, 2000

§ 102(e) Date: Feb. 14, 2000

(87) PCT Pub. No.: WO99/65361

PCT Pub. Date: Dec. 23, 1999

(30) Foreign Application Priority Data

Jun. 16, 1998 (JP) ..... 10-168966

(51) Int. Cl.[7] ..... A47B 9/20
(52) U.S. Cl. ..... 108/147.19; 248/188.4
(58) Field of Search ..... 108/144.11, 147.19, 108/147.11; 248/108.8, 108.2, 108.4, 108.5

(56) References Cited

U.S. PATENT DOCUMENTS 1,125,668 * 1/1915 Deming ..... 248/188.4
2,819,134 * 1/1958 Klevholm ..... 108/147
2,885,181 * 5/1959 McCully et al. ..... 248/188.4 X
3,045,389 * 7/1962 Arnit ..... 248/188.4
3,104,493 * 9/1963 Nalle ..... 248/188.4
3,117,392 * 1/1964 Junkunc ..... 108/147.19 X
3,595,180 * 7/1971 Swoyer ..... 108/147.19 X
3,908,565 * 9/1975 Burnett ..... 108/147
5,588,624 * 12/1996 Woodham ..... 248/188.4

FOREIGN PATENT DOCUMENTS 0743033 11/1996 (EP) .
8-308655 11/1996 (JP) .
10-211046 8/1998 (JP) .

* cited by examiner

*Primary Examiner*—Jose V. Chen
(74) *Attorney, Agent, or Firm*—Banner & Witcoff, Ltd.

(57) ABSTRACT

In order to simplify an arrangement of a desk which can integrate a mechanism to adjust a height of a top plate and a mechanism to adjust a level of a top plate, in a desk in which a height of a top plate can be varied within a predetermined range through a height adjust mechanism, the desk is so arranged that the top plate is supported by a plurality of expansible leg support posts, and the height adjust mechanism makes use of the leg support posts and can adjust an expansile amount of the leg support posts individually within the predetermined range through a little larger than the predetermined range.

5 Claims, 5 Drawing Sheets

DESK WITH EXPANSIBLE LEGS

This invention relates to a desk and, more particularly, to a desk which is preferably used in offices or at home.

BACKGROUND ART

Desks are generally standardized at a height of a top plate to a certain degree. However, if several different standards exist or the standard varies in countries, a desk having a different specification has to be made according to the standard. In addition, a learning desk for children has to be changed in a height of a top plate in accordance with a growth degree of a child. However, it is a waste if the desk is traded for a new one every time the child grows.

Under these circumstances, a desk wherein a height of a top plate can be changed by means of a height adjust mechanism has been developed and is in use presently.

Generally, in an ordinary desk, adjusters are provided at a plurality of positions where each of a bottom end of the legs is supported and level adjustment by means of the adjusters makes it possible to cooperate with an uneven floor on which the desk is placed. In the above-mentioned desk, an adjuster adjust mechanism and a height adjust mechanism are separately incorporated into the desk. This increases a number of components and processing steps and it would become a factor which hinders a promotion of lowering cost and weight or of simplifying an arrangement of the desk.

DISCLOSURE OF THE INVENTION

In order to solve the above-mentioned problems, attention is paid to a point that both an adjuster adjust mechanism and a top plate height adjust mechanism are done by an operation of up and down. From the above viewpoint, these functions are carried out by a common mechanism in the desk of the invention.

More specifically, the desk in accordance with the invention is characterized by that a height of a top plate can be changed through a height adjust mechanism within a predetermined range which is larger than a level adjust amount by means of an ordinary adjuster wherein the top plate is supported by a plurality of expansible leg support posts, and the height adjust mechanism makes use of the leg support posts and can adjust an expansile amount of the leg support posts individually within the predetermined range through a little larger than the predetermined range. In the above case, the range within the predetermined range through a little larger than the predetermined range means both a range within the predetermined range and a range within a little larger than the predetermined range.

The leg support post may comprise a support post member and a grounding member which is arranged at the lower end of the support post member and which can protrude or recede, and the height adjust mechanism may be provided with a fixing member which fixes the grounding member to the support post member at a predetermined position.

To obtain an improved operationability and stability with a simple arrangement, it is effective if the leg support post comprises a support post member and a grounding member which is arranged at the lower end of the support post and which can protrude or recede, and the height adjust mechanism comprises a screw means which helically connects the support post member and the grounding member with allowing the support post member to make an up and down movement.

More concretely, it is effective if the screw means comprises a nut member which is mounted on the support post member unrotatably and a screw shaft which projects upward over the grounding member and the projecting side is helically connected with the nut member.

It is preferable that the grounding member is provided with a handling portion which is to allow the screw shaft to screw up and down relative to the nut member.

To improve appearance regardless of a position at which the leg support post is adjusted, it is preferable that a cover is mounted on the support post member with the upper end thereof allowed to make a sliding movement up and down and the cover is so arranged that a lower end thereof covers the grounding member and the handling portion.

In the above case, to secure an improved operationability, it is effective if a movable position which alternatively exposes the handling portion is provided at a part of an underside of the cover.

As described above, the desk in accordance with the invention has an arrangement in which the top plate is supported by a plurality of expansible leg support posts and the height adjust mechanism makes use of the leg support posts and can adjust an expansile amount of the leg support posts individually within the predetermined range through a little larger than the predetermined range.

In accordance with the arrangement, when each of the leg support posts is adjusted to change substantially the same amount by operating the height adjust mechanism, the height of the top plate is also changed within the predetermined range in accordance with the adjusted amount. When several of the leg support posts are adjusted to change just a little, the level of the adjusted leg support posts only is changed, thereby to be able to cope with an uneven floor.

As mentioned above, the height adjust mechanism carries out a function to adjust not only the height of the top plate but also the level of each leg support posts. Therefore, the cost and the weight of the desk can be reduced due to a common component used for different objects, and appearance of the desk can also be kept in a good looking condition. In addition, with the adjustment applied, it becomes possible to effectively adjust the top plate so as to be horizontal when placed on a steeply inclined floor.

As a result, it becomes possible for the height adjust mechanism to carry out a function not only to adjust the height of the top plate but also to adjust a level of every leg support post individually and it can effectively conduct adjustment to an inclined floor.

If the leg support post comprises a support post member and a grounding member and the height adjust mechanism is provided with a fixing member which fixes the grounding member to the support post member at a predetermined position, the leg support post can be expansible with a simple arrangement and stability can also be secured.

Especially, if the leg support post comprises a support post member and a grounding member and the support post member and the grounding member are connected by a screw means which comprises a nut member and a screw shaft, an improved operationability and stability can be obtained with a simple arrangement. In addition, since the leg support post can be kept in an adjusted position by itself when expansile amount is adjusted, there is no need of other fixing operation and fixing members.

If the grounding member is provided with a handling portion which gives a force to operate the screw means, the handling portion and the grounding member can be made integrally, resulting in a merit in a processing step.

If a cover is mounted on the support post member with the upper end thereof allowed to make a sliding movement up and down and the cover is so arranged that a lower end thereof covers the grounding member and the handling portion, appearance of the leg support post can be kept in a good looking condition no matter what position the leg support post is adjusted.

In this case, if a movable member which alternatively exposes the handling portion to a side of the cover is mounted on the lower end of the cover, there is no need to move the cover so as to slide every time the handling portion is handled, thereby to simplify the operation of adjusting a level of the leg support post.

BEST MODES OF EMBODYING THE INVENTION

Figure 1:
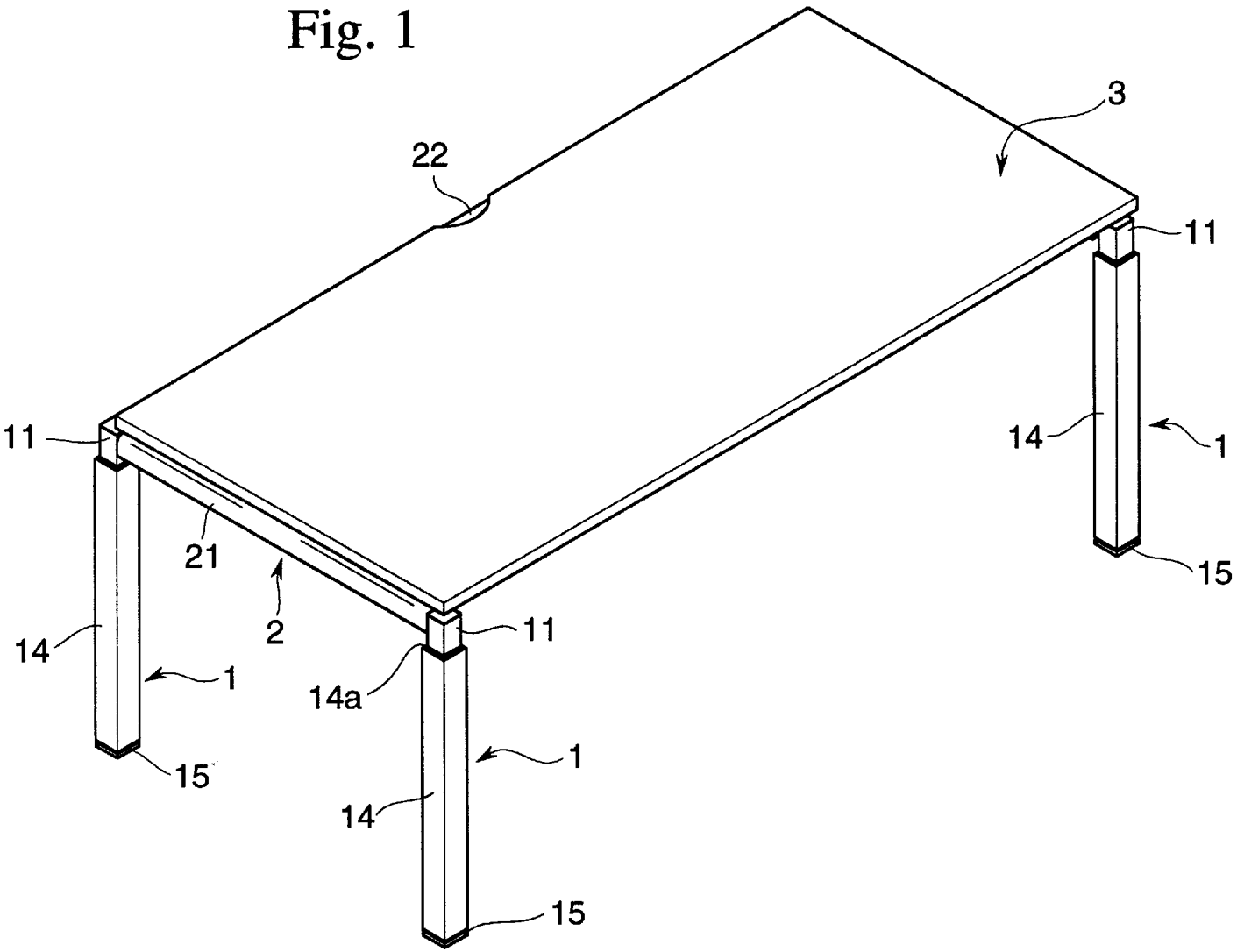
FIG. 1 is an overall perspective view showing one embodiment of the invention.
Figure 2:
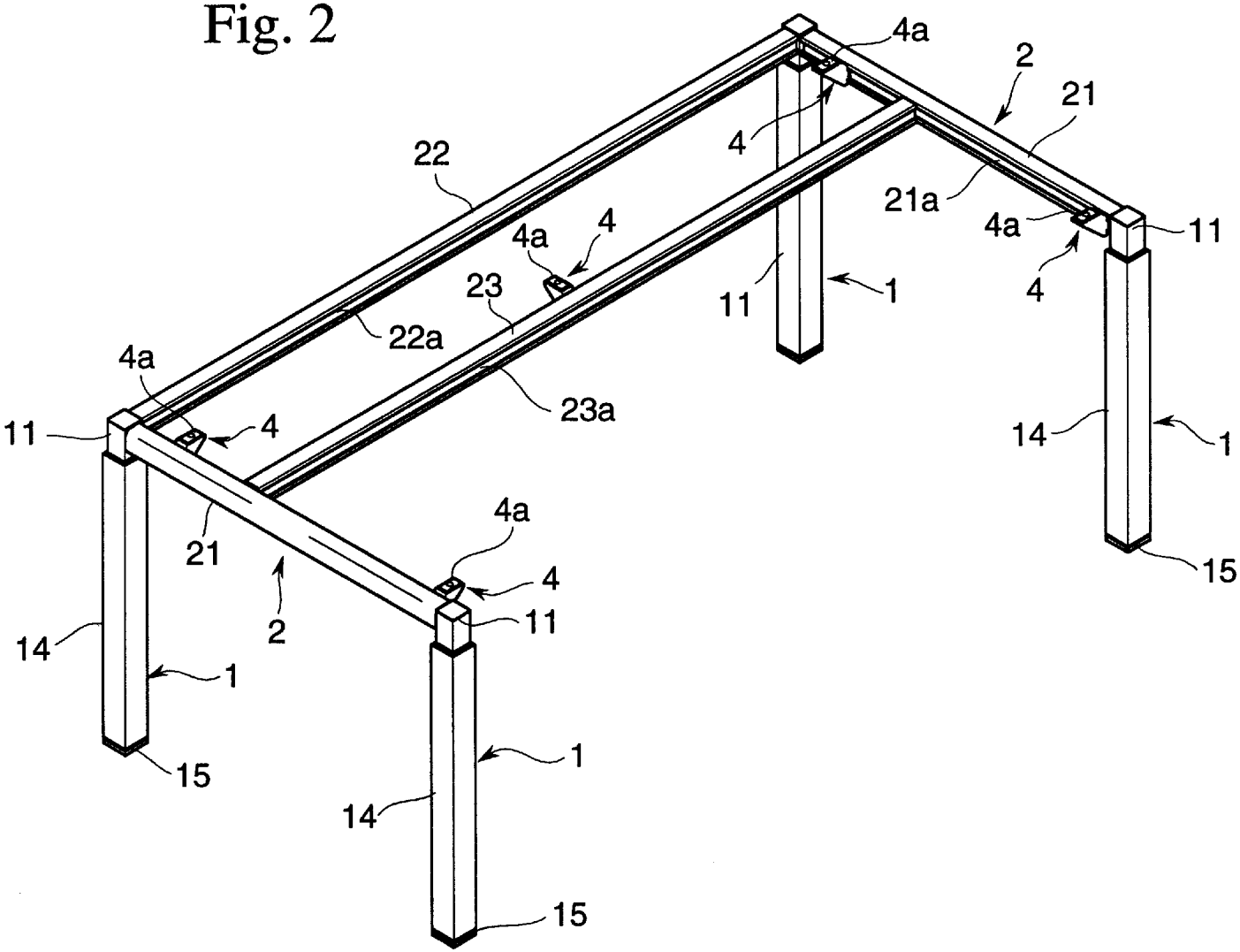
FIG. 2 is a partially cut out perspective view of the embodiment.
Figure 3:
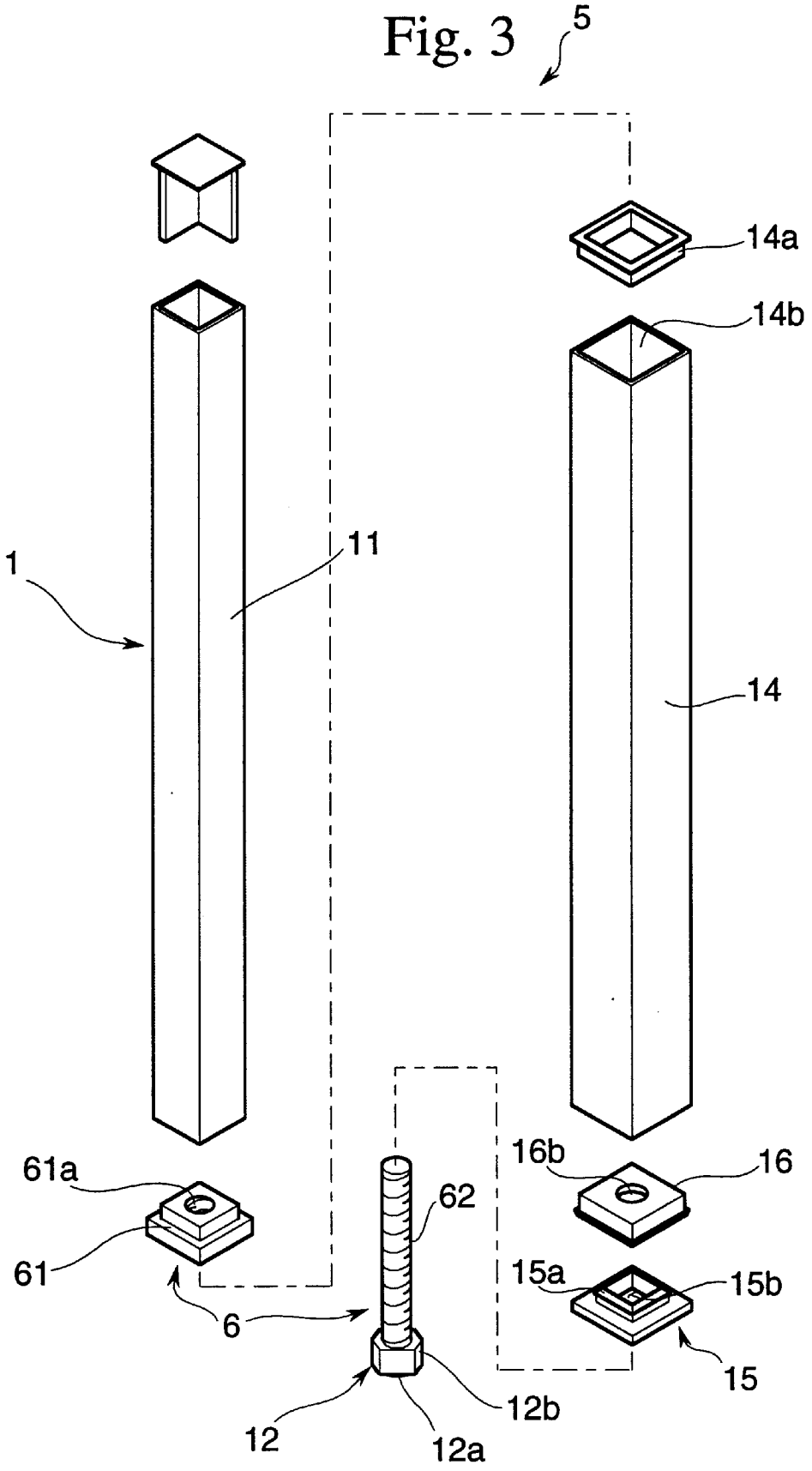
FIG. 3 is an exploded perspective view of a leg support post of the embodiment.

The invention will be described in detail with reference to an embodiment thereof shown in the accompanying drawings.

The desk has an arrangement, as shown in FIGS. 1 through 4, in which each of four leg support posts 1 is connected at the upper end thereof through a frame 2 and a top plate 3 is supported by the frame 2.

Each of the leg support posts 1 is of a square pipe and arranged at four corners or near the corners of the rectangular top plate 3 with an upper end of the leg support post 1 facing to an underside of the top plate 3. The frame 2 comprises a pair of right and left frame members 21 which connect the front and back leg support posts 1 along a direction of depth at adjacent the top end of the inner surfaces which face each other, a front frame member 22 which connects the right and left leg support posts 1 arranged front side along a direction of width at adjacent the top end of the inner surfaces which face each other, and reinforcing frame member 23 which connects the right and left frame members 21 at a little front of the center of the inner surfaces which face each other. This frame 2 constitutes a self standing structure together with each of the leg support posts 1 by prohibiting each other from being apart. Each of the right and left frame members 21 and the front frame member 22 is made of a common extruded form of a material having rigidity such as aluminum which is cut in a required length and is provided with a rail groove 21*a*, 22*a* which opens at one side facing inward of the frame members 21, 22. The reinforcing frame member 23 also is made of substantially the same extruded form of a material having rigidity such as aluminum which is cut in a required length and is provided with an opening as a rail groove 23*a* which opens at both sides of the reinforcing frame member 23.

In this embodiment, brackets 4 each having a face 4*a* to support the top plate 3 are mounted on the right and left frame members 21 at two positions thereof, namely back and front of the right and left frame members 21 by making use of the above mentioned rail groove 21*a* and another bracket 4 having a face 4*a* to support the top plate 3 is mounted on the reinforcing frame member 23 at the center thereof by making use of the rail groove 23*a*. Then the top plate 3 is placed on the faces 4*a* of the above-mentioned five brackets 4 and fixed thereto by means of a screw from underside of the top plate 3. The top late 3 has an arrangement in which a plurality of materials for a top plate are overlapped along a direction of depth so as to show a grain of wood along a direction of width. With this arrangement, the top plate 3 produces a high strength against a load which is applied by placing something even if the top plate 3 is supported by the brackets 4 at only four corners and the center thereof.

With the above arrangement, in this embodiment, the top plate 3 is so arranged that the height can be varied, for example, within a predetermined range of approximately 80 mm through the height adjust mechanism 5.

In the height adjust mechanism 5, for making use of the leg support posts 1 as a construction element, the leg support posts 1 have an arrangement in which a support post member 11 and a grounding member 12 are expansibly connected to each other and an expansile amount of each leg support posts 1 can be adjusted individually within the above-mentioned predetermined range through a little larger than the range by means of a screw means 6.

More specifically, the support post member 11 is made of a material having rigidity such as aluminum which is extruded into a square pipe. On the bottom end of the leg support posts 11 a nut member 61 having a threaded hole 61*a* at the center thereof is mounted with a part of the nut member 61 inserted thereinto so as to restrict the nut member 61 from being rotated.

In the grounding member 12, a bottom end thereof forms a grounding area 12*a* and a side area 12*b* serves as a handling portion which has a shape of a nut with which a wrench is to be engaged from a side direction. And a screw shaft 62 projects upward from the upper face of the handling portion 12*b*. The screw means 6 comprises the threaded hole 61*a* and the screw shaft 62 and has an arrangement in which a projecting side of the screw shaft 62 is helically connected to the threaded hole 61*a* of the nut member 61. An effective range of the screw means 6 in which the screw shaft 62 is prevented from being out of joint of the threaded hole 61*a* is set at least a little larger than the above-mentioned 80 mm.

Further, in this embodiment, a rectangle pipe cover 14 which is a little larger than the support post member 11 made of resin or something like that is arranged so that the upper end of the cover 14 fits over the support post member 11. On the inner face of the upper end of the cover 14 mounted is a close member 14*a* which closes a clearance between the support post member 11 and the cover 14. The cover 14 is arranged with an inner face 14*b* thereof affixed to an outer face 61*b* of the nut member 61. Then the cover 14 is affixed to two points, namely the outer face 11*a* of the support post member 11 and the outer face 61*b* of the nut member 61 through the close member 14*a* so as to make a sliding movement up and down without being loosened. The cover 14 is kept in a condition so as not to be apart from the support post member 11 because the close member 14*a* is kept in a tight contact with the cover 14 and the support post member 11 if no force is applied thereto. The cover 14 is so arranged that a lower end thereof covers the grounding member 12.

A movable member 15 which alternatively exposes the handling portion 12*b* to a side of the cover 14 is mounted on the lower end of the cover 14 through a limit member 16. The movable member 15 is provided with an engaging claw 15 which faces outward at the upper end thereof and a hollow portion 15*b* which covers the grounding member 12 at the lower end thereof. The limit member 16 is provided with a clearance 16*a* which engages the engaging claw 15 with the lower end thereof so as to allow the engaging claw 15 to make an up and down movement and which restrains the up and down movement of the engaging claw 15 within a given range. The movable member 15 can be moved within the given range so as to alternatively expose or cover the side of the handling portion 12*b*. In the limit member 16, the upper face 16*c* serves as a role to set a limit on the lowest position of the nut member 61 and a through hole 16*b* through which the screw shaft 62 is to be passed is provided at the center of the limit member 16.

Next a method to deal with this embodiment will be explained. First, lift up the movable member 15 as shown in FIG. 5 from a condition shown in FIG. 4 so as to expose a side of the handling portion 12*b*. Next, engage a wrench which is not shown in drawings with the handling portion 12*b* and rotate the screw shaft 62 to a predetermined direction so as to move the nut member 61 along an axial direction of the screw shaft 62. Then an amount of the grounding member 12 projecting from the support post member 11, namely, an expansile amount L of the leg support post 1 as a whole can be adjusted within a range as far as the nut member 61 engages with the screw shaft 62. With the same manner applied to all of the other leg support posts 1, the height of the top plate 3 can be changed within a range, for example, 680 mm to 760 mm. It is a matter of course the above operation can be done with the desk placed upside down and lower end of the leg support posts 1 protruded upwardly.

In case the top plate 3 is not stably placed horizontally due to an error of adjustment or unevenness of the floor F even if the desk is placed on a floor F with the grounding area 12*a* of the leg support post 1 being grounded after the height of the top plate 3 is adjusted, adjust only the required leg support post 1 in the same manner as in the case of the above so as to move the grounding member 12 a very slight amount with a wrench applied to the handling portion 12*b* of the required leg support post 1. Then the height of each leg support posts 1 can be adjusted individually.

As mentioned above, in this embodiment, the height adjust mechanism 5 which makes use of expansion and contraction of the leg support post 1 carries out a function to adjust not only the height of the top plate 3 but also the level of each leg support posts 1. Therefore, the number of components and the number of working steps required for manufacture and assembly is greatly reduced as compared with conventional desks in which these functions are carried out by different mechanisms, thereby to reduce the cost and the weight of the desk as a whole and to simplify the arrangement of the desk.

In addition, with applying the adjustment, if, for example, one pair of the two pairs of the leg support posts 1 which support two sides of the top plate 3 facing each other are adjusted to have the same expansible amount and the other pair are adjusted differently, the top plate 3 can be adjusted so as to be horizontal when placed on a steeply inclined floor F. Further, since these functions accompany to the leg support post 1 alone, in other words, do not accompany to the top plate 3 or the like, an arrangement of the top plate 3 can be simplified and this makes it possible to prevent the space under the desk from being unreasonably reduced and to improve the appearance of the leg support post 1.

Especially, in this embodiment, since the leg support post 1 comprises the support post member 11 and the grounding member 12 which is arranged at the lower end of the support post member 11 and which can protrude or recede, and the height adjust mechanism 5 comprises the screw means 6 which helically connects the support post member 11 to the grounding member 12 with allowing the support post member 12 to make an up and down movement, a stable and smooth movement can be obtained with an extremely easy operation and the grounding member 12 can be securely kept at a desired position by making use of the self-lock mechanism of the screw means 6 without any other fixing members.

Since the screw means 6 basically comprises the nut member 61 which is mounted on the support post member 11 unrotatably and the screw shaft 2 which projects upward over the grounding member 12 and the projecting side is helically connected with the nut member 61, required function can effectively be obtained with the least required number of components. In this case, since the handling portion 12*b* for rotating the screw shaft 62 is formed in the side of the grounding member 12, a common component can be shared, and since the handling portion 12*b* can be operated just near the grounding member 12, it becomes easy to operate the handling portion 12*b*.

Figure 4:
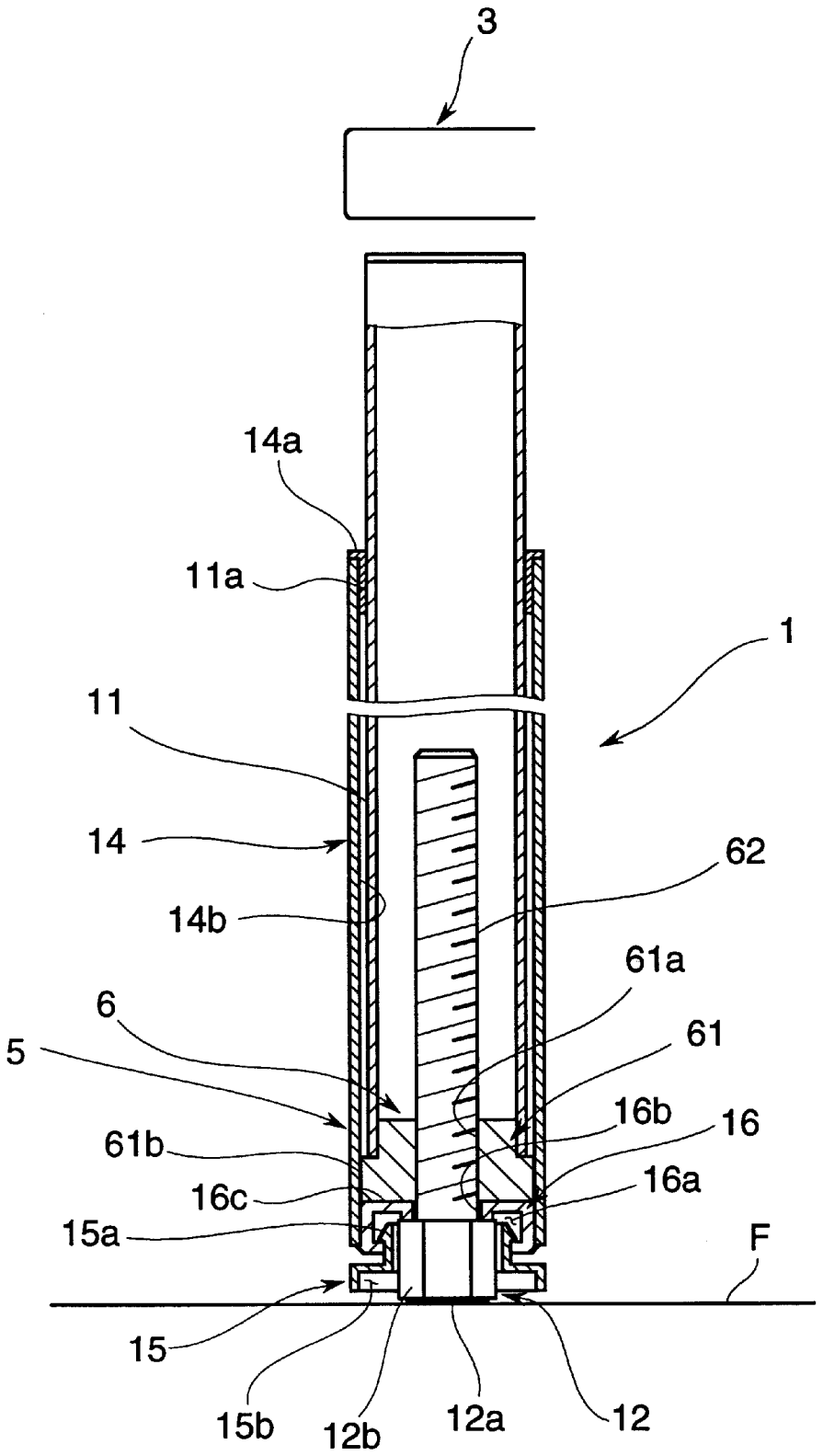
FIG. 4 is an elevational cross sectional view of the leg support post.
Figure 5:
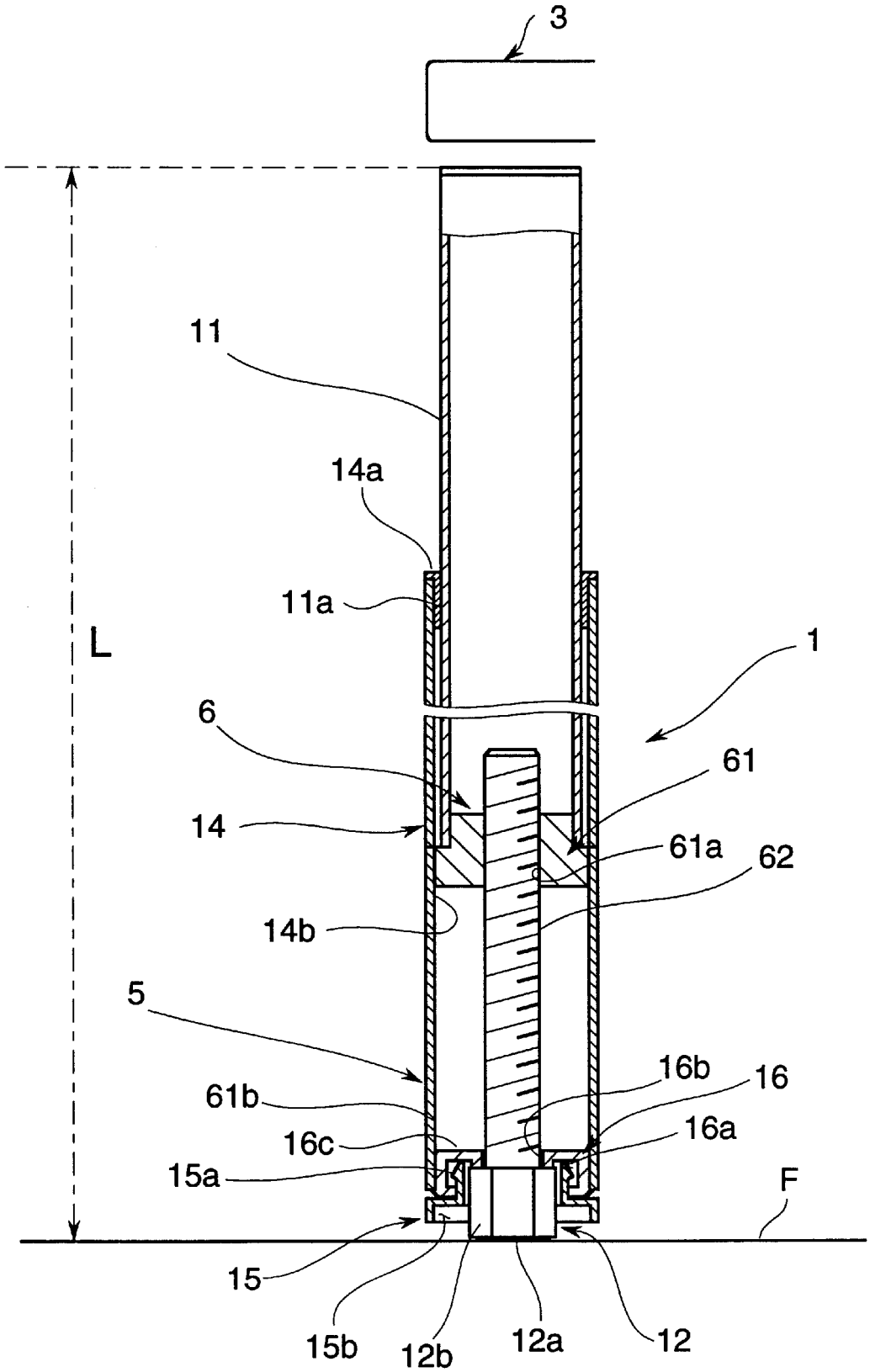
FIG. 5 is an explanatory view corresponding to FIG. 4.

Further, in this embodiment, the cover 14 is attached to the support post member 11 with an upper end thereof allowed to make a sliding movement up and down, and the lower end of the cover 14 always covers the grounding member 12, even if the leg support post 11 is expanded, for example, as shown in FIG. 4 and 5, resulting in keeping an appearance of the leg support post 1 in a good looking condition.

In this case, since the movable member 15 which alternatively exposes the handling portion 14*b* to the outside of the cover 14 is provided at the lower end of the cover 14, there is no need of moving the cover 14 so as to slide every time the handling portion 14*b* is handled, thereby to simplify the operation of adjusting a level of the leg support post 1.

The component parts are not limited to the illustrated constructions, but there may be various modifications and changes without departing from the scope of the invention. For example, this does not exclude an arrangement in which a fixing member such as a screw fixes the support post to the grounding member which constitutes the leg support post at a predetermined position. The above-mentioned position is just one embodiment of the invention, and it is needless to say that the adjustable amount of the top plate or the level can be set at any amount tailored to an object or a usage of the desk. Further, the desk described in this specification also includes a concept of, so to speak, a table.

Possible Applications in Industry

As mentioned above, the desk in accordance with the invention is used when it is needed that a height of the top plate be changed according to a user's requirement, especially preferably used for a learning desk for children which is required to change a height of the top plate according to a growing rate of the child. The desk is also preferably used in a case a floor on which the desk is to be placed is steeply inclined.

What is claimed is:

1. A desk comprising a top plate supported by a plurality of expansible leg support posts wherein a height adjust mechanism adjusts a height of said top plate within a predetermined range, said height adjust mechanism comprising said expansible leg support posts wherein said height adjust mechanism can adjust an expansible amount of said leg support posts individually within said predetermined range through an amount larger than said predetermined range and wherein each of said leg support posts comprises a support post member and a grounding member located at the lower end of the support post member, wherein the grounding member may move to protrude from or recede into the support post member and the grounding member further comprises a handling portion, and the height adjust mechanism comprises a screw means which helically connects said support post member and said grounding member, said screw means providing an up and down movement through an operation of said handling portion, the desk further comprising a cover mounted on said support post member, said cover being movable up and down by sliding and a lower end of said cover covers said grounding member and said handling portion.

2. The desk of claim 1 wherein each of said leg support posts comprises a support post member and a grounding member located at the lower end of the support post member, wherein the grounding member protrudes from or recedes into the support post member, said height adjust mechanism further comprising a fixing member which fixes said grounding member to the support post member at a predetermined position.

3. The desk of claim 1 wherein said screw means comprises a nut member mounted on the support post member unrotatably and a screw shaft projecting upward from the grounding member and helically connected with said nut member.

4. The desk of claim 3 wherein said grounding member further comprises a handling portion to screw said screw shaft up and down relative to said nut member.

5. The desk of claim 4 further comprising a movable member, which alternatively exposes the handling portion, provided at a part of an underside of the cover.

* * * * *